US005516319A

United States Patent [19]

Nessel

[11] Patent Number: 5,516,319

[45] Date of Patent: May 14, 1996

[54] AID FOR SWIMMERS

[76] Inventor: Edward H. Nessel, 10 Irene Ct., Edison, N.J. 08820

[21] Appl. No.: 492,189

[22] Filed: Jun. 19, 1995

[51] Int. Cl.[6] ..... A63B 31/00

[52] U.S. Cl. ..... 441/56; 441/58

[58] Field of Search ..... 441/55, 56, 57, 441/58; D21/237, 238

[56] References Cited

U.S. PATENT DOCUMENTS

| | | | |
|---|---|---|---|
| 1,726,728 | 9/1929 | Adams | 441/57 |
| 2,159,972 | 5/1939 | Larson | 441/58 |
| 2,313,979 | 3/1943 | Tuma | 441/58 |
| 2,389,196 | 11/1945 | Harmon | 441/58 |
| 3,328,812 | 7/1967 | Berthiot | 441/58 |

*Primary Examiner*—Stephen Avila

[57] ABSTRACT

An aid for swimmers comprising a planar sheet is disclosed. The planar sheet has an exterior surface and an interior surface essentially parallel with each other throughout at least the majority of their extent. The sheet also has four fingers and a thumb extending forwardly therefrom with spaces between the fingers and the thumb. A plurality of large grooves are formed on the exterior surface in the central extent thereof and a plurality of small grooves are formed on the exterior surface in the fingers and thumb thereof. A plurality of straps are formed of a tubular configuration positioned on the interior surface and are secured with retainers for facilitating attachment to the hand of a swimmer.

2 Claims, 4 Drawing Sheets

AID FOR SWIMMERS

BACKGROUND OF THE INVENTION

1. Field of the Invention

The present invention relates to a new and improved aid for swimmers and, more particularly, pertains to assisting in the training of swimmers through a specially designed handpiece.

2. Description of the Prior Art

The use of devices for use by swimmers and other athletes to assist in training and to enhance performance is known in the prior art. More specifically, devices for use by swimmers and other athletes to assist in training and to enhance performance heretofore devised and utilized for the purpose of assisting swimmers and other athletes through supplemental devices utilized with various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for assisting in the training of swimmers through a specially designed handpiece. By way of example, U.S. Pat. No. 3,580,213 to Yuen discloses flotation paddles joined by a central shaft.

U.S. Pat. No. 4832,643 to Schoofs discloses a hand paddle for use by swimmers.

U.S. Pat. No. 5,114,371 to Alonzo discloses a water paddle and flotation device for use by swimmers.

U.S. Pat. No. 5,288,254 to Elson discloses a swimmer's hand paddle.

U.S. Pat. No. Des. 262,477 to Lewis discloses swim paddles for arm attachment.

Lastly, U.S. Pat. No. Des. 274,744 to Smithers discloses a strength-building swim paddle.

In this respect, the aid for swimmers according to the present invention substantially departs from the conventional concepts and designs of the prior art, and in doing so provides an apparatus primarily developed for the purpose of assisting in the training of swimmers through a specially designed handpiece.

Therefore, it can be appreciated that there exists a continuing need for a new and improved aid for swimmers which can be used for assisting in the training of swimmers through a specially designed handpiece. In this regard, the present invention substantially fulfills this need.

SUMMARY OF THE INVENTION

In view of the foregoing disadvantages inherent in the known types of devices for use by swimmers and other athletes to assist in training and to enhance performance now present in the prior art, the present invention provides an improved aid for swimmers. As such, the general purpose of the present invention, which will be described subsequently in greater detail, is to provide a new and improved aid for swimmers and methods which have all the advantages of the prior art and none of the disadvantages.

To attain this, the present invention essentially comprises an aid for swimmers comprising a planar sheet having an exterior surface and an interior surface essentially parallel with each other throughout at least the majority of their extent, the sheet having four fingers and a thumb extending forwardly therefrom with spaces between the fingers and the thumb; a plurality of large grooves formed on the exterior surface in the central extent thereof and a plurality of small grooves formed on the exterior surface in the fingers and thumb thereof; a plurality of straps formed of a tubular configuration positioned on the interior surface and secured with retainers for facilitating attachment to the hand of a swimmer; a rearwardly extending supplemental planar section thicker than the planer sheet adjacent to the rearward end thereof and functions to accommodate the wrist of a wearer, the supplemental planar section having a supplemental strap for mounting to the wrist of a wearer with a recess to secure the strap in position; a plurality of apertures formed in the fingers and thumb adjacent to the peripheral edges thereof in proximity to the spaces; a plurality of inserts for each space, each of the inserts including a cylindrical member with an axial recess and apertures therethrough for coupling with the apertures of the planar sheet with pins for coupling the cylindrical members to the apertures of the planar sheet, each insert having a pair of downwardly extending flaps for closing the spaces between the fingers and between the fingers and the thumbs; and a generally cylindrical projection on the interior surface of the sheet for accommodating the palm of the hand of a user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved aid for swimmers which has all the advantages of the prior art devices for use by swimmers and other athletes to assist in training and to enhance performance and none of the disadvantages.

It is another object of the present invention to provide a new and improved aid for swimmers which may be easily and efficiently manufactured and marketed.

It is a further object of the present invention to provide a new and improved aid for swimmers which is of a durable and reliable construction.

An even further object of the present invention is to provide a new and improved aid for swimmers which is susceptible of a low cost of manufacture with regard to both materials and labor, and which accordingly is then susceptible of low prices of sale to the consuming public, thereby making such devices for use by swimmers and other athletes to assist in training and to enhance performance economically available to the buying public.

Still yet another object of the present invention is to provide a new and improved aid for swimmers which provides in the apparatuses and methods of the prior art some of the advantages thereof, while simultaneously overcoming some of the disadvantages normally associated therewith.

Even still another object of the present invention is to assist in the training of swimmers through a specially designed handpiece.

Lastly, it is an object of the present invention to provide an aid for swimmers comprising a planar sheet. The planar sheet has an exterior surface and an interior surface essentially parallel with each other throughout at least the majority of their extent. The sheet also has four fingers and a thumb extending forwardly therefrom with spaces between the fingers and the thumb. A plurality of large grooves are formed on the exterior surface in the central extent thereof and a plurality of small grooves are formed on the exterior surface in the fingers and thumb thereof. A plurality of straps are formed of a tubular configuration positioned on the interior surface and are secured with retainers for facilitating attachment to the hand of a swimmer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
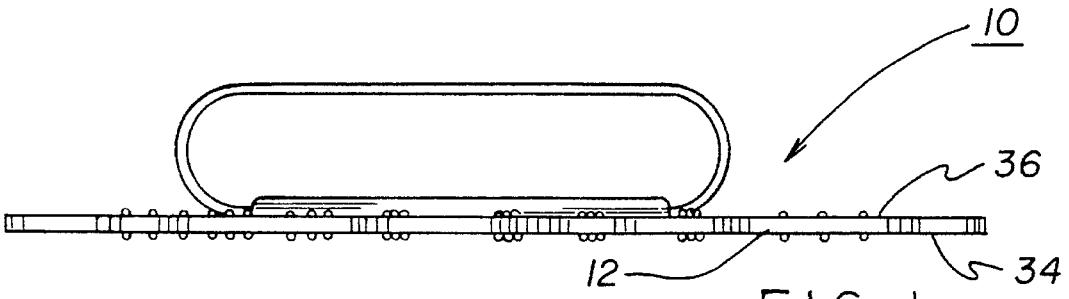
FIG. 1 is a front elevational view of the preferred embodiment of the new and improved aid for swimmers constructed in accordance with the principles of the present invention.
Figure 2:
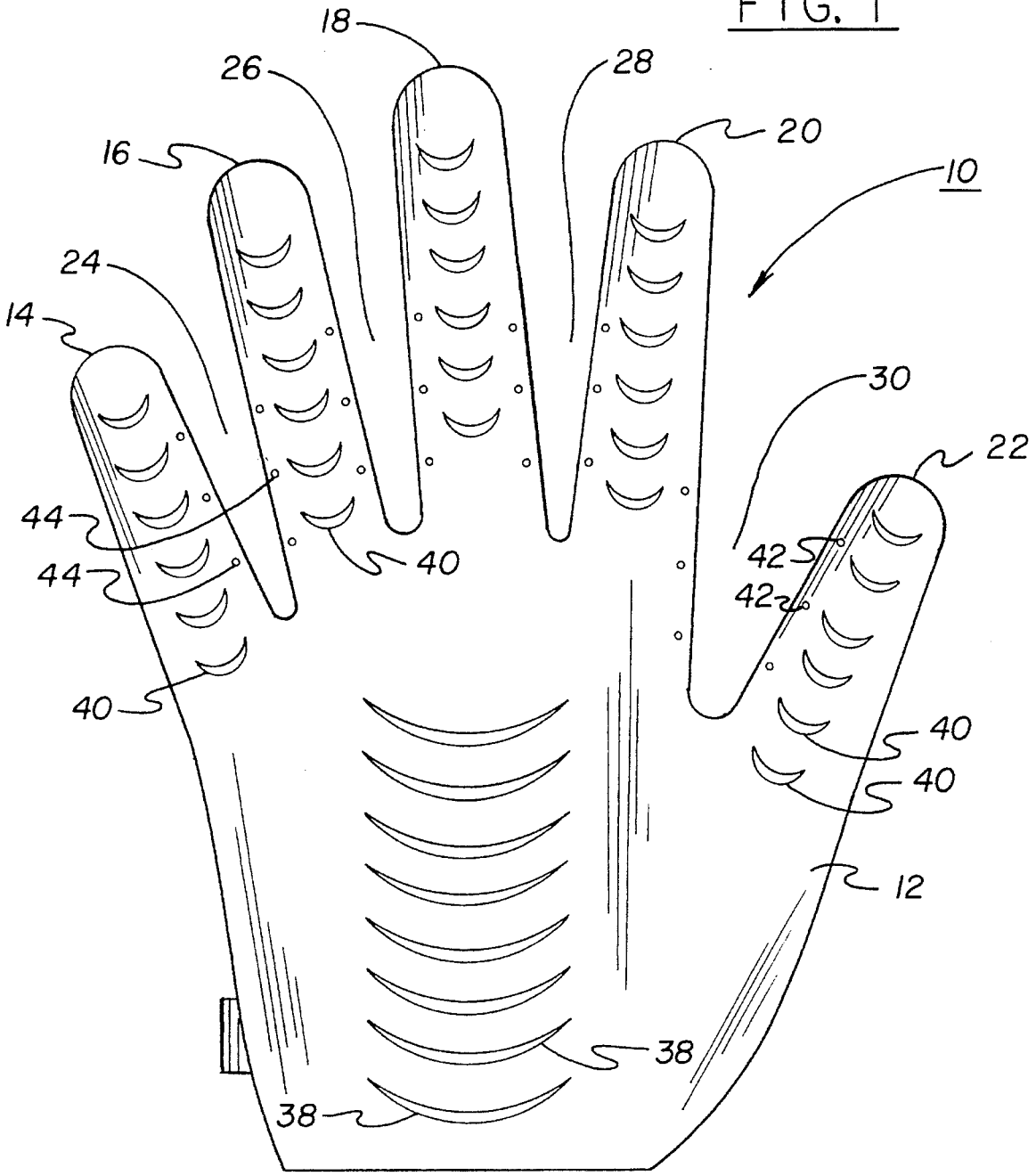
FIG. 2 is a side elevational view of the device shown in FIG. 1.

With reference now to the drawings, and in particular to FIG. 1 thereof, the preferred embodiment of the new and improved aid for swimmers embodying the principles and concepts of the present invention and generally designated by the reference numeral 10 will be described.

The present invention, the new and improved aid for swimmers, is a system 10 comprised of a plurality of components. In their broadest context, the components include a planar sheet, grooves, straps, apertures in the fingers and associated inserts, and, in the alternative, a rearwardly extending planar section and/or a generally cylindrical projection adjacent the palm of a hand of a user. Each of the individual components is specifically configured and correlated one with respect to the other so as to attain the desired objectives.

More specifically, the aid 10 of the present invention has as its basic component a planar sheet 12. Such sheet has an exterior surface 34 and an interior surface 36. Such surfaces are essentially parallel with respect to each other throughout at least a majority of their extent. The sheet has four fingers 14,16,18,20 and a thumb 22. Such fingers and thumb extend forwardly from the major portion of the sheet. Spaces 24,26,28,30 are located between the fingers and the thumb. Two such planar sheets are preferably utilized, one for each hand of a swimmer utilizing the device as an aid. Their constructions are identical except that they are mirror images with respect to each other.

Next provided are a plurality of large grooves 38. Such large grooves are formed on the exterior surface of the sheet at a central extent thereof. They are crescent shaped in configuration. In addition, a plurality of small grooves 40 are formed on the exterior surface of the planar sheet. Such small grooves are located in the fingers and thumbs thereof. Again such grooves are of a crescent shape and include friction to enhance the swimming capabilities of a user utilizing the aid.

Coupling of the sheet to the hand of a user are a plurality of straps 46,86. Such straps are formed of a tubular material in a loop configuration. They are positioned on the interior surface of the planar sheet. They are secured in position through retainers 50,88. The function of this arrangement is for facilitating the secure attachment of the sheet and its component elements to the hand or hands of a swimmer.

Figures 3, 4, 5:
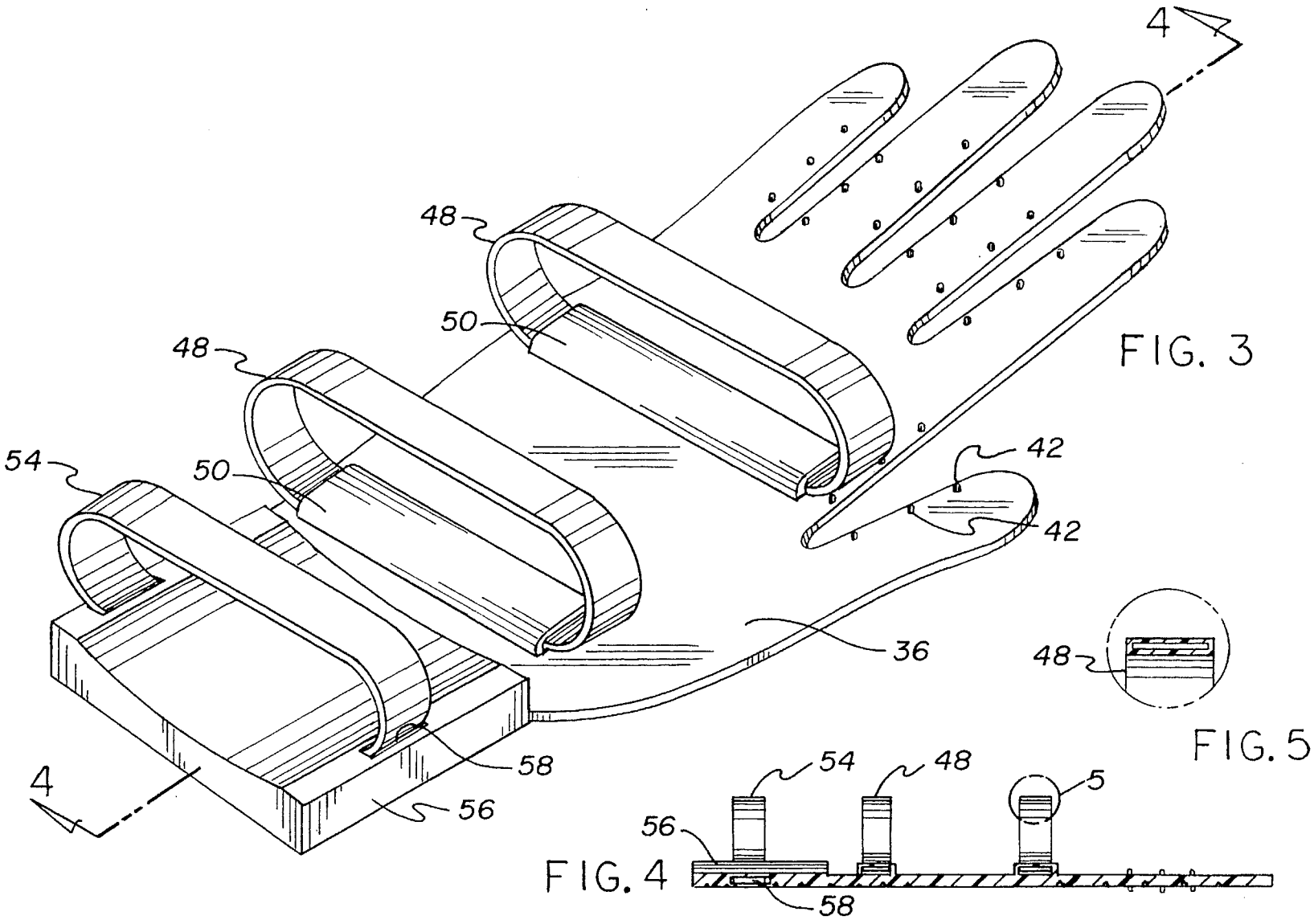
FIG. 3 is a perspective illustration of the device shown in FIGS. 1 and 2 but with a wrist extension included thereon.
FIG. 4 is a side elevational view of the device shown in FIG. 3.
FIG. 5 is an enlarged illustration of a portion of one of the straps shown in FIG. 4 taken at circle 5 of FIG. 4.
Figure 6:
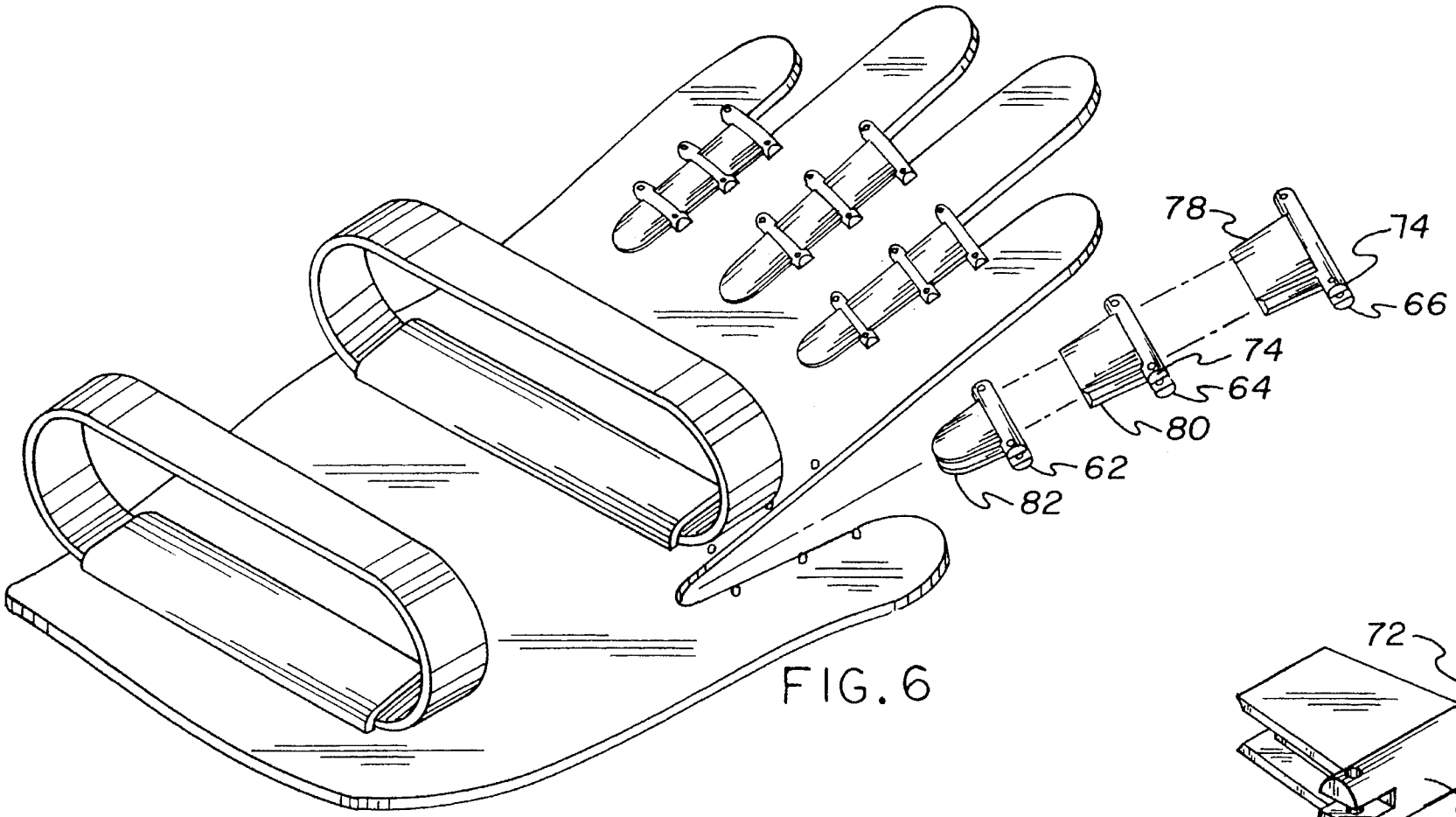
FIG. 6 is a perspective illustration of a device similar to that shown in FIGS. 2 and 3 but illustrating supplemental inserts.
Figure 7:
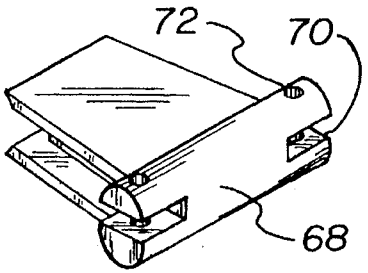
FIG. 7 is an enlarged perspective illustration of one of the inserts shown in FIG. 6.

Next provided is a rearwardly extending supplemental planar section 56. Note the embodiments of FIGS. 3 and 4. Such planar section 56 is thicker than the planar sheet throughout the majority of its extent. The supplemental planar section is located adjacent to the rearward end of the planar sheet. Such supplemental planar section functions to accommodate the wrist of a wearer. Such supplemental planar section 56 has a supplemental strap 54 for mounting to the wrist of a wearer. A recess 58 through the planar section 56 serves to secure the strap in position with respect to the remainder of the aid and the hand and wrist of a user.

In association with the planar sheet, there are utilized, optionally, a plurality of inserts 62,64,66. A plurality of such inserts are located for each space between the fingers and between the thumb and the adjacent finger. Each of the inserts includes a cylindrical member 68. Each cylindrical member is formed with an axial recess 70 and includes apertures therethrough. Such apertures are for coupling with the apertures 42 of the planar sheet. In association therewith, cylindrical pins 72 are utilized for coupling the cylindrical members to the apertures of the planar sheet. This functions to fill the space of the planar sheet between the fingers and thumb.

Each insert has a pair of downwardly extending flaps 78,80,82. The flaps function when utilized together for closing the spaces between the fingers and between the fingers and the thumb. Any number of such inserts may be utilized for a particular application or, when desired, the inserts may be removed totally. Such is a function of the intended use of the device to the particular needs of the user.

Figure 8:
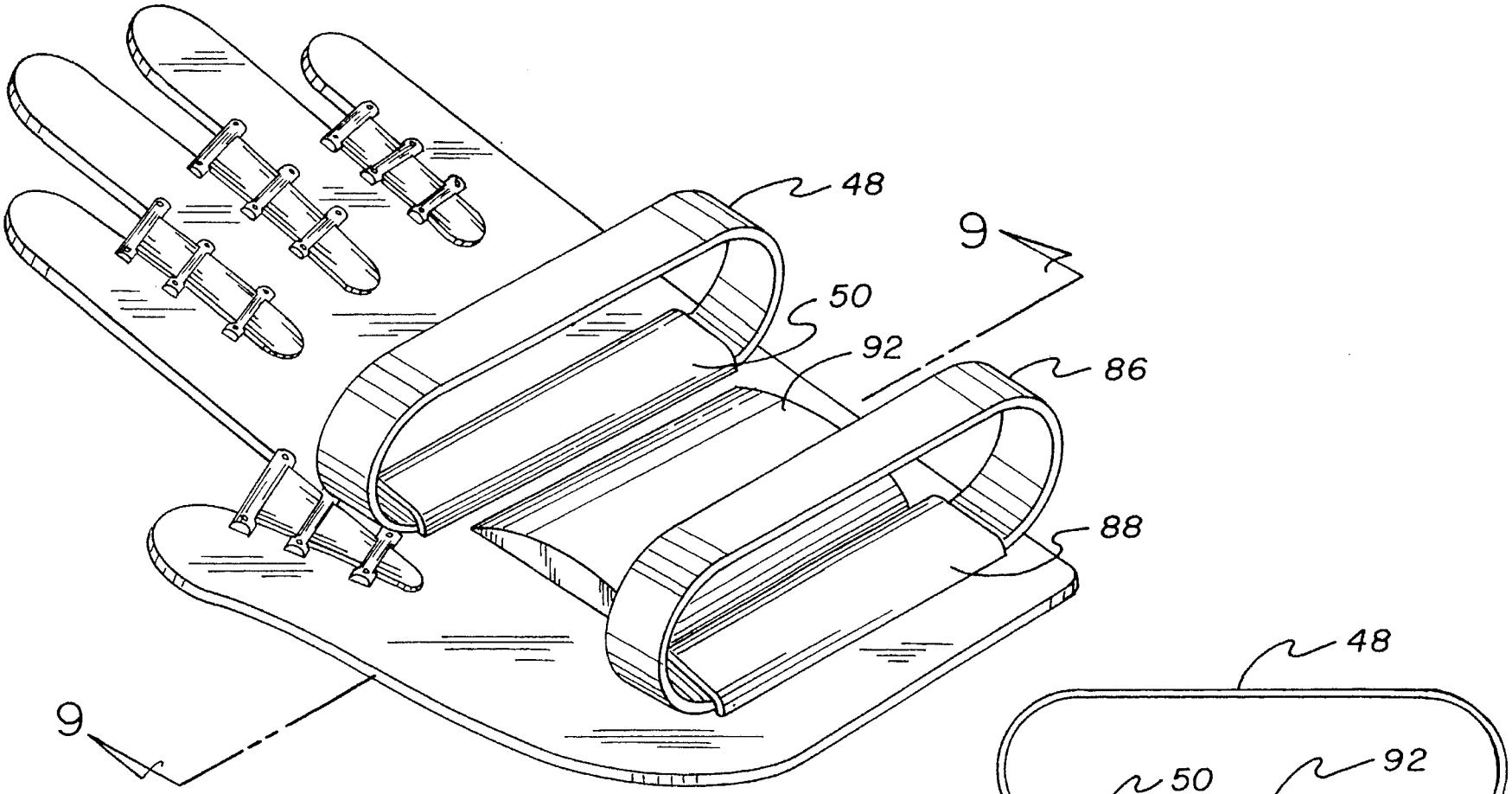
FIG. 8 is a perspective illustration similar to that of FIG. 6 but illustrating an alternate embodiment thereof.
Figure 9:
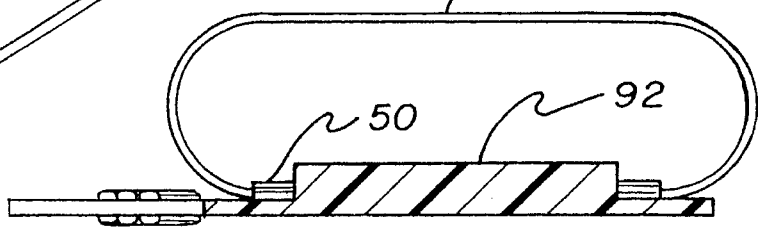
FIG. 9 is a cross-sectional view taken along line 9—9 of FIG. 8.

The last component of the aid 10 is a cylindrical projection 92. Such is in the alternate embodiment as illustrated in FIGS. 8 and 9. Such projection 92 is on the interior surface of the planar sheet 12. Its function is for accommodating the palm of the hand of a user for greater comfort and efficiency.

The present invention comprises paddles which are placed on the hands to train competitive swimmers and others in the correct technique by their utilization.

The paddles are made of plastic and are thin molded impressions of the hands. Contrary to popular belief, the fingers are spread apart slightly, rather than cupped, and holes are added in some units to reduce water resistance without decreasing the effectiveness. They fit over the palm and front of the fingers, with straps around the back to keep them in place. For those who cannot fully open their hand because of arthritis or other problems, the paddle has a bulge that fits against the cupped palm to minimize any discomfort. To improve the feel at the fingertips, serious swimmers may like to have dimples in that area as well as extensions which assist in keeping the wrist stiff throughout the pull stroke. Their paddles will also have less space between the fingers, requiring a stronger pull. All paddles could be made in several sizes.

It has been determined that hand and finger positioning is very important to competitive swimmers. As stated, the fingers are slightly spread apart and the hand and wrist are held flatter for best results. The present invention serves to teach how it is done. The present invention also has a much better feel than other similar devices when they are being used because they are literally molded to the shape of the hands.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved aid for swimmers comprising, in combination:

a planar sheet having an exterior surface and an interior surface essentially parallel with each other throughout at least the majority of their extent, the sheet having four fingers and a thumb extending forwardly therefrom with spaces between the fingers and the thumb;

a plurality of large grooves formed on the exterior surface in the central extent thereof and a plurality of small grooves formed on the exterior surface in the fingers and thumb thereof;

a plurality of straps formed of a tubular configuration positioned on the interior surface and secured with retainers for facilitating attachment to the hand of a swimmer;

a rearwardly extending supplemental planar section thicker than the planer sheet adjacent to the rearward end thereof and functions to accommodate the wrist of a wearer, the supplemental planar section having a supplemental strap for mounting to the wrist of a wearer with a recess to secure the strap in position;

a plurality of apertures formed in the fingers and thumb adjacent to the peripheral edges thereof in proximity to the spaces;

a plurality of inserts for each space, each of the inserts including a cylindrical member with an axial recess and apertures therethrough for coupling with the apertures of the planar sheet with pins for coupling the cylindrical members to the apertures of the planar sheet, each insert having a pair of downwardly extending flaps for closing the spaces between the fingers and between the fingers and the thumbs; and a generally cylindrical projection on the interior surface of the sheet for accommodating the palm of the hand of a user.

2. An aid for swimmers comprising:

a planar sheet having an exterior surface and an interior surface essentially parallel with each other throughout at least the majority of their extent, the sheet having four fingers and a thumb extending forwardly therefrom with spaces between the fingers and the thumb;

a rearwardly extending supplemental planar section thicker than the planer sheet adjacent to the rearward end thereof and functions to accommodate the wrist of a wearer, the supplemental planar section having a supplemental strap for mounting to the wrist of a wearer with a recess to secure the strap in position;

a plurality of large grooves formed on the exterior surface in the central extent thereof and a plurality of small grooves formed on the exterior surface in the fingers and thumb thereof, a plurality of apertures formed in the fingers and thumb adjacent to the peripheral edges thereof in proximity to the spaces; and a plurality of straps formed of a tubular configuration positioned on the interior surface and secured with retainers for facilitating attachment to the hand of a swimmer.

* * * * *